US008453295B2

(12) United States Patent
Studebaker

(10) Patent No.: US 8,453,295 B2
(45) Date of Patent: Jun. 4, 2013

(54) DRY VACUUM CLEANING APPLIANCE

(76) Inventor: Roy Studebaker, Centralia, WA (US)

( * ) Notice: Subject to any disclaimer, the term of this patent is extended or adjusted under 35 U.S.C. 154(b) by 294 days.

(21) Appl. No.: 12/806,744

(22) Filed: Aug. 18, 2010

(65) Prior Publication Data

US 2012/0042909 A1 Feb. 23, 2012

(51) Int. Cl.
*A47L 9/16* (2006.01)

(52) U.S. Cl.
USPC ..... 15/347; 15/352

(58) Field of Classification Search
USPC ..... 15/320, 347, 321, 322, 352, 353
See application file for complete search history.

(56) References Cited

U.S. PATENT DOCUMENTS 5,350,432 A * 9/1994 Lee ..... 55/408
6,243,914 B1 * 6/2001 Studebaker ..... 15/322
6,332,239 B1 * 12/2001 Dubos et al. ..... 15/353
7,395,579 B2 * 7/2008 Oh ..... 15/347
2010/0206344 A1 * 8/2010 Studebaker ..... 134/56 R

* cited by examiner

*Primary Examiner* — Dung Van Nguyen
(74) *Attorney, Agent, or Firm* — Charles J. Rupnick, Attorney at Law

(57) ABSTRACT

An in-line bagless dry vacuum cleaning appliance having a vacuum conduit within a separator tube, the vacuum conduit having spaced apart first and second vacuum suction apertures communicating with an exhaust connector; a cyclone chamber communicating with an intake connector and encompassing the first vacuum suction apertures for forming a cyclonic flow region between the central vacuum conduit and an interior wall of the separator tube; a particle receiving chamber communicating with the cyclone chamber; an axial cyclone inlet communicating between the cyclone chamber and the intake connector of the separator tube; a particle separator dividing the particle receiving chamber from the cyclone chamber and forming a first transfer gap therebetween adjacent to the interior wall of the separator tube for receiving disentrained particles into the particle receiving chamber from the cyclone chamber; and a filter between the particle receiving chamber and the second vacuum suction aperture.

20 Claims, 5 Drawing Sheets

DRY VACUUM CLEANING APPLIANCE

FIELD OF THE INVENTION

The present invention to bagless dry vacuum cleaning appliances for cleaning surfaces, and in particular to a bagless dry vacuum cleaning appliance and method for operation in combination with a fluid cleaning appliance for dry vacuum cleaning carpet and other flooring surfaces of dust and debris.

BACKGROUND OF THE INVENTION

Many fluid cleaning appliances, such as the system illustrated herein, are known for cleaning carpeting and other flooring, wall and upholstery surfaces. The cleaning apparatuses and methods most commonly used today apply cleaning fluid as a spray under pressure to the surface whereupon the cleaning fluid dissolves the dirt and stains and the apparatus scrubs the fibers while simultaneously applying a vacuum or negative pressure to extract the cleaning fluid and the dissolved soil. A high pressure blower is used to generate the strong vacuum necessary for extracting the soiled cleaning fluid and rout it to the cleaning unit's waste storage receptacle.

Prior to fluid cleaning the flooring, it is generally advantageous to initially dry vacuum the surface for removing loose dust and debris which can clog the equipment. This initial dry vacuum cleaning is desirable because, once the carpet is wetted, deep seated dust and debris cannot be drawn from the carpet, even under the vacuum pressures generated by professional fluid cleaning appliances. For the purpose of initial dry vacuum cleaning the carpet, operators have heretofore utilized a conventional dry vacuum cleaner that is independent from the fluid cleaning appliance. The independent dry vacuum cleaning appliance is necessary because fluid cleaning systems do not include filters for separating dry dust and debris from an intake airstream. Rather, dust and dirt dissolved in the soiled cleaning fluid is simply routed to the cleaning unit's liquid waste storage receptacle.

Professional fluid cleaning appliances, such as the systems illustrated herein, operate at much higher pressures than residential vacuum cleaning appliances, on the order of 15-20 inches of mercury for professional fluid cleaning appliances versus 5-8 inches of mercury for residential vacuum cleaning appliances, and, and much high air volumes, on the order of 300-400 cubic feet of air per minute for professional fluid cleaning appliances versus 100 cubic feet per minute for residential vacuum cleaning appliances. These much higher operating pressures and volumes would normally make the use of the professional fluid cleaning appliance more effective than a residential vacuum cleaning appliance in initial dry vacuum cleaning the carpet, and would result in a much cleaner carpet.

Unfortunately, because the blowers generating the vacuum in professional fluid cleaning appliances operate at such high pressures and close mechanical tolerances, any loose dry dust and debris can easily clog them, and if clogged, the blower can quickly burn-out and be destroyed, rendering the cleaning system inoperative. Therefore, the vacuum function of professional fluid cleaning appliances is not operated dry for fear of clogging and burning-out the very sensitive high pressure blower.

Some fluid cleaning appliances do include dry vacuum channels independent of the fluid cleaning channels. These dry vacuum channels can be operated by connecting an independent vacuum source to a vacuum supply line above the cleaning head. Again, the fluid cleaning vacuum source is not utilized for dry vacuum cleaning because of the danger to the high pressure blowers if they become clogged by dust and dirt carried in the intake airstream.

Neither of these conventional dry vacuum cleaning options is satisfactory since each requires the operator to at least bring in a separate vacuum source, if not a complete dry vacuum system independently of the fluid cleaning appliance.

FIG. 1 illustrates a typical prior art professional fluid cleaning system as illustrated in U.S. Pat. No. 6,243,914 issued to the inventor of the present invention and incorporated herein by reference. It is to be understood that this cleaning system is typically mounted in a van or truck for mobile servicing of carpets and flooring in homes and businesses.

The typical prior art fluid cleaning system 1 illustrated in FIG. 1 includes a main liquid waste receptacle 3 into which soiled cleaning fluid is routed. A cleaning head or nozzle 5 is mounted on a rigid vacuum wand 7 which includes a handle 8 for controlling cleaning head 5. A supply of pressurized hot liquid solution of cleaning fluid is supplied to cleaning head 5 via a cleaning solution delivery tube 9 arranged in fluid communication with a cleaning solution inlet orifice 11 of cleaning head 5 for delivering there through a flow of pressurized liquid cleaning solution to fluid cleaning solution spray jets 13 of cleaning head 5. Carpet cleaning head 5 typically includes a rectangular, downwardly open truncated pyramidal envelope 15 which contains the cleaning fluid spray that is applied to the carpet or other flooring, as well as forming a vacuum plenum for the vacuum retrieving the soiled liquid for transport to waste receptacle 3. An intake port 16 of the vacuum wand 7 is coupled in fluid communication with the vacuum plenum of cleaning head 5.

Mounted above the main waste receptacle 3 is a cabinet 17 housing a vacuum source and supply of pressurized hot liquid cleaning fluid. Soiled cleaning fluid is routed from cleaning head 5 into waste receptacle 3 via rigid vacuum wand 7 and a flexible vacuum return hose 19 coupled in fluid communication with an exhaust port 20 thereof, whereby spent cleaning solution and dissolved soil are withdrawn under a vacuum force supplied by the fluid cleaning system, as is well known in the art. A vacuum control valve or switch 21 is provided for controlling the vacuum source 8.

FIG. 2 illustrates details of operation of the typical prior art fluid cleaning system 1 illustrated in FIG. 1. Here, the main waste receptacle 3, as well as the vacuum source and cleaning fluid supply cabinet 17, are shown in partial cut-away views for exposing details thereof. The cleaning fluid is drawn through cleaning solution delivery tube 9 from a supply 23 of liquid cleaning solution in the cabinet 17. The vacuum for vacuum return hose 19 is provided by a vacuum source 25, such as a high pressure blower, driven by a power supply 27. The blower vacuum source 25 communicates with the main waste receptacle 3 through an air intake 29 coupled into an upper portion 31 thereof and, when operating, develops a powerful vacuum in an air chamber 33 enclosed in the receptacle 3.

Vacuum return hose 19 is coupled in communication with waste receptacle 3 through a drain 35, for example, at upper portion 31, remote from intake 29. Vacuum return hose 19 feeds soiled cleaning fluid into waste receptacle 3 as a flow 37 of liquid soiled with dissolved dust, dirt and stains, as well as undissolved particulate material picked up by the vacuum return but of a size or nature as to be undissolvable in the liquid cleaning fluid. The flow 37 of soiled cleaning fluid enters into waste receptacle 3 through drain 35 and forms a pool 39 of soiled liquid filled with dissolved and undissolved debris. A float switch 41 or other means avoids overfilling the waste receptacle 3 and inundating the blower 25 through its air intake 29. A screen or simple filter may be applied to remove gross contaminates from the soiled liquid flow 37 before it reaches the pool 39, but this is a matter of operator choice since any impediment to the flow 37 reduces crucial vacuum pressure at the cleaning head 5 for retrieving the soiled liquid from the cleaned carpet or other surface.

Soiled liquid cleaning fluid effectively filters air drawn into the waste receptacle 3 by dissolving the majority of dust, dirt and stains, and drowning and sinking any undissolved debris whereby it is sunk into the pool 39 of soiled liquid and captured therein. Thus, the soiled liquid in the vacuum return hose 19 effectively filters the air before it is discharged into the enclosed air chamber 34, and no airborne particles of dust and dirt are available to escape into the enclosed air chamber 33 floating above the liquid pool 39.

Because the soiled liquid in the flow 37 from the vacuum return hose 19 and the pool 39 of soiled liquid effectively filter the air in the return from the cleaning head 5, it has been unnecessary to filter the air in the air chamber 33 before it is taken into the blower air intake 29 in order to avoid damage to the sensitive blower 25.

Some operators have installed filters at the blower air intake 29. However, this is believed to be ineffective because the blower 25 operates at such high pressures and volumes, on the order of 2-to-4 times higher vacuum pressures and 3-to-4 times high air volumes over residential vacuum cleaning appliances, as disclosed herein, that airborne dust and debris tend to be sucked straight through any ordinary prior art filter. Furthermore, any ordinary prior art filter that would effectively protect the sensitive high pressure blower 25 from airborne dust and debris would severely impact the vacuum generated at the cleaning head 5 and thereby greatly limit the ability to extract and retrieve the soiled cleaning fluid, leaving behind carpet or flooring that is wet with the soiled cleaning fluid. Therefore, the fluid cleaning appliance does not support an air filter for removing airborne dry dust and debris from the intake airstream, and filters to protect the high pressure blower 25 from airborne dust and debris are not used. Instead, operators simply avoid the danger inherent in exposing the sensitive high pressure blower 25 to airborne dust and debris particles by limiting its use to extracting and retrieving the soiled cleaning fluid, and utilizing a conventional stand-alone dry vacuum cleaning appliance for initial pre-vacuum cleaning the surface before applying the fluid cleaning appliance.

FIG. 3 illustrates another fluid cleaning appliance as illustrated in U.S. patent application Ser. No. 12/378,663 filed Feb. 17, 2009, in the name of the inventor of the present invention and incorporated herein by reference. Here, rigid vacuum wand 7 includes an auxiliary dry vacuum connection 43 for connecting cleaning head 5 to an independent vacuum source 45 via an independent vacuum supply line 47. Dry vacuum connection 43 communicates with dry vacuum cleaning slots 49 adjacent to cleaning solution spray jets 13 in the cleaning head 5. Dry vacuum cleaning slots 49 are sized large enough to receive hair, dirt, gravel and other extraneous large debris. A cleaning solution flow control switch or valve 51 permits switching between the fluid cleaner and dry vacuum processes of the cleaning head 5.

When not in use, auxiliary dry vacuum connection 43 can be sealed by a self-sealing cap or stopper 53.

Thus, in the prior art it was necessary either to dry vacuum the surface using a completely independent dry vacuum cleaner appliance (not shown) for removing loose dust and debris before fluid cleaning using the fluid cleaning system 1, or to dry vacuum using an independent vacuum source 45 connected to the cleaning head 5 via vacuum supply line 47 coupled into the auxiliary dry vacuum connection 43.

SUMMARY OF THE INVENTION

The present invention overcomes limitations of the prior art by providing a novel in-line bagless dry vacuum cleaning appliance for operation with the fluid cleaning head of a fluid cleaning appliance for initial dry vacuum cleaning of carpet and other flooring surfaces, wall surfaces and upholstery. Accordingly, the novel in-line bagless dry vacuum cleaning appliance of the invention eliminates the need for either a completely independent dry vacuum cleaner appliance (not shown) for removing loose dust and debris before fluid cleaning, or an independent vacuum source connected to the cleaning head via an auxiliary dry vacuum connection, for initially dry vacuum cleaning the surface to be fluid cleaned. Furthermore, the 2-to-4 times higher vacuum pressures and 3-to-4 times high air volumes of a fluid cleaning appliance over residential vacuum cleaning appliances, provides more effective removal of surface and deep seated dust and debris and results in a much cleaner carpet.

According to one aspect of the present invention, a novel in-line bagless dry vacuum cleaning appliance is provided in combination with a fluid cleaning appliance, the novel in-line dry vacuum cleaning appliance being situated in-line with a rigid vacuum wand 7 and vacuum return hose 19 for utilizing the vacuum source of the fluid cleaning system for initial dry vacuum cleaning and removal of dust and debris.

According to another aspect of the invention, the in-line bagless dry vacuum cleaning appliance including a separator tube having an intake connector and an exhaust connector. A vacuum conduit is positioned within the separator tube and extended from the exhaust connector toward the intake connector, the vacuum conduit having a first vacuum suction aperture and a second vacuum suction aperture spaced away therefrom with both first and second vacuum suction apertures being in fluid communication with the exhaust connector. A cyclone chamber is positioned within the separator tube in fluid communication with the intake connector thereof, with the cyclone chamber substantially encompassing the first vacuum suction aperture of the vacuum conduit for forming a cyclonic flow region between the central vacuum conduit and an interior wall of the separator tube. A particle receiving chamber within the separator tube is in fluid communication with the cyclone chamber and the cyclonic flow region. An axial cyclone inlet is coupled in fluid communication between the cyclone chamber and the intake connector of the separator tube. A particle separator divides the particle receiving chamber from the cyclone chamber and the cyclonic flow region and forms a first transfer gap therebetween adjacent to the interior wall of the separator tube for receiving particles disentrained from an intake airstream into the particle receiving chamber from the cyclone chamber. A filter is positioned between the particle receiving chamber and the second vacuum suction aperture.

According to another aspect of the invention, the axial cyclone inlet is formed of a barrier having at least one air inlet formed therethrough in fluid communication with a spiral wall inclined between the intake connector and the cyclone chamber.

According to another aspect of the invention, the cleaning appliance further includes an incoming vacuum chamber formed between the barrier and the intake connector of the separator tube, the incoming vacuum chamber being in fluid communication between the cyclone chamber and the intake connector.

According to another aspect of the invention, the cleaning appliance further includes a second transfer gap between the central vacuum conduit and the interior wall of the separator tube in a position between the particle separator and the particle receiving chamber and offset from the first transfer gap.

According to another aspect of the invention, the second transfer gap is formed of an at least partial dam extended between the central vacuum conduit and the interior wall of the separator tube in a position between the particle separator and the particle receiving chamber.

According to another aspect of the invention, the second vacuum suction aperture is further positioned within a clean air chamber that is in fluid communication with the particle receiving chamber, and the filter is further positioned between the particle receiving chamber and the clean air chamber.

According to another aspect of the invention, the particle separator is a frusto-conical particle separator that is coupled to the central vacuum conduit, the frusto-conical particle separator extends radially outwardly from the central vacuum conduit toward interior wall of the separator tube and forms the first transfer gap therebetween.

According to another aspect of the invention, the cleaning appliance further includes a cleaning head comprising a cleaning solution inlet orifice arranged in fluid communication with one or more cleaning solution spray jets thereof, and one or more vacuum cleaning slots; and a cleaning solution delivery tube arranged in fluid communication with the cleaning solution inlet orifice of the cleaning head for delivering there through a flow of pressurized liquid cleaning solution to the one or more cleaning solution spray jets; a substantially rigid vacuum wand having an intake thereof attached to the cleaning head in fluid communication with the one or more vacuum cleaning slots, and an exhaust remote from the intake and in fluid communication therewith, the remote exhaust port being coupled in fluid communication with the intake connector of the separator tube; and a vacuum return in fluid communication between the exhaust connector of the of the separator tube and a vacuum source.

According to another aspect of the invention, the present invention provides a method for dry vacuum cleaning and bagless removal of dust and debris utilizing the vacuum source of the fluid cleaning system.

Additional aspects, advantages and features of the invention are set forth in part in the description which follows and will become apparent to those having ordinary skill in the art upon examination of the following or may be learned from practice of the invention. Aspects and advantages of the invention may be realized and attained as particularly pointed out in the appended claims.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

Figure 1:
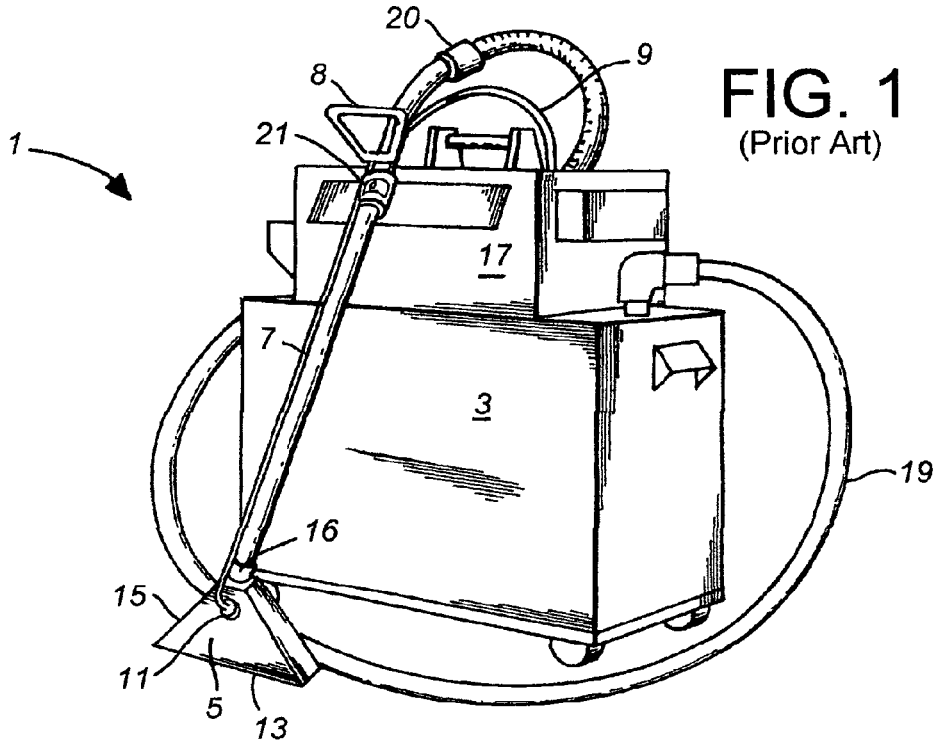
FIG. 1 (Prior Art)
FIG. 1 is a prior art fluid cleaning appliance as disclosed in U.S. Pat. No. 6,243,914.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

In the Figures, like numerals indicate like elements.

Figure 2:
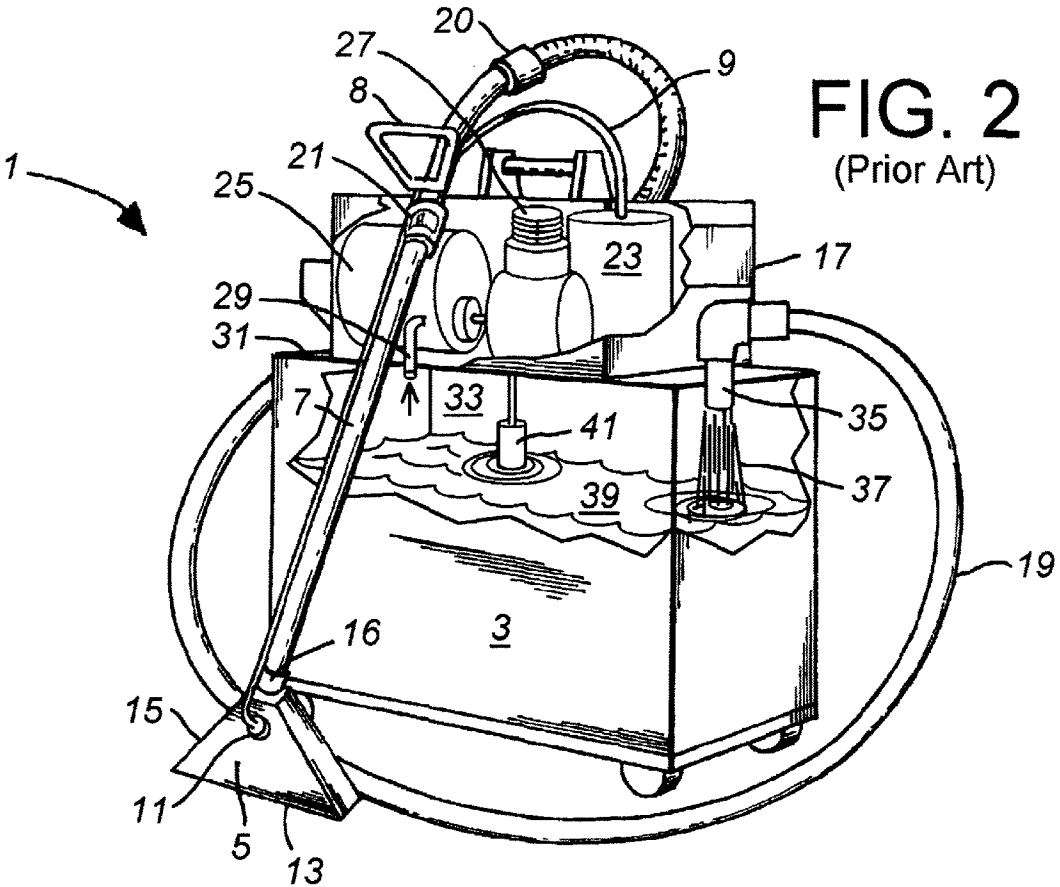
FIG. 2 (Prior Art)
FIG. 2 illustrates details of operation of the typical prior art fluid cleaning system 1 illustrated in FIG. 1.
Figure 4:
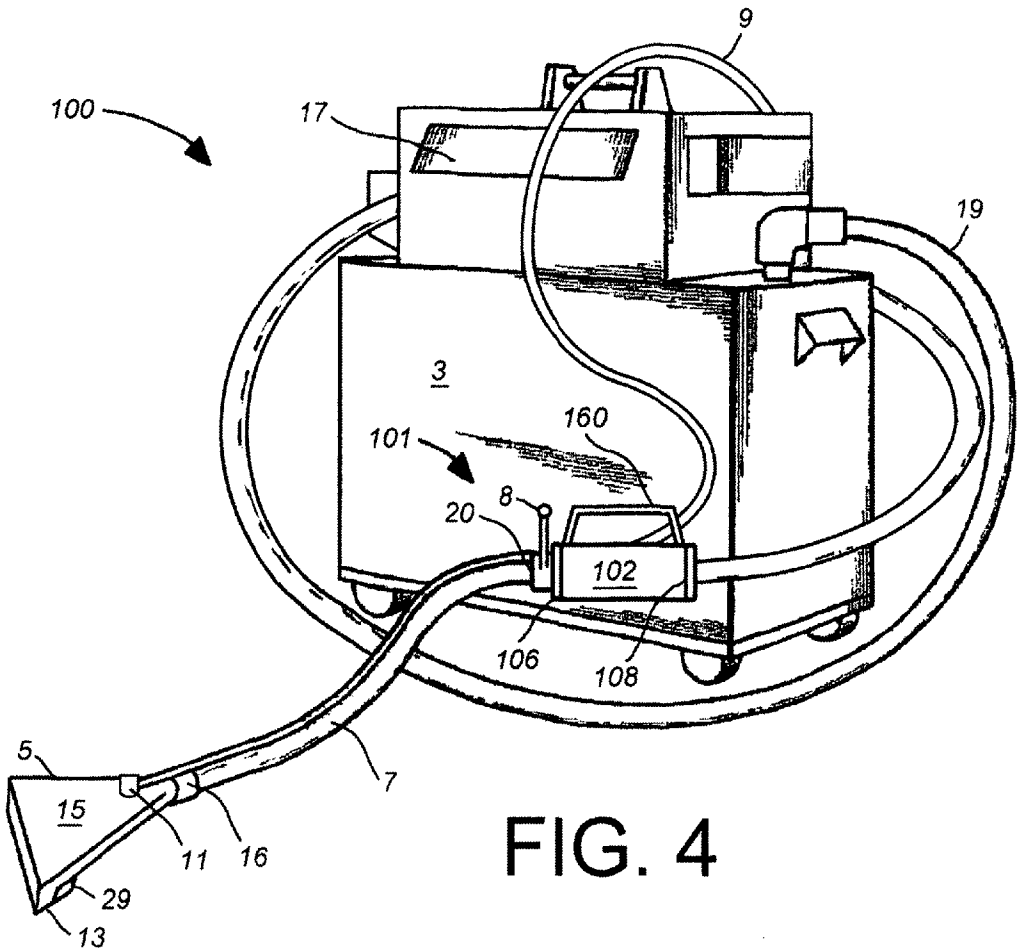
FIG. 4 is an exemplary illustration of a combination dry/fluid cleaning appliance having a novel in-line bagless dry vacuum cleaning appliance in combination with a fluid cleaning system of the type illustrated in FIGS. 1 and 2.

FIG. 4 is an exemplary illustration of a combination dry/fluid cleaning appliance 100 having a novel in-line bagless dry vacuum cleaning appliance 101 in combination with fluid cleaning system 1 of the types illustrated in FIGS. 1 and 2, whereby it is unnecessary to provide separate dry vacuum connection 43 in rigid vacuum wand 7 for connecting cleaning head 5 to an independent vacuum source via an independent vacuum supply line, as illustrated in FIG. 2. As illustrated here, in-line bagless dry vacuum cleaning appliance 101 is coupled midstream in-line between cleaning head or nozzle 5 and vacuum source 25 for separating material entrained in a particulate filled airstream flowing through vacuum wand 7 to waste receptacle 3 via flexible vacuum return hose 19. In particular, appliance 101 is a cyclonic debris separator formed of an elongated substantially cylindrical cyclonic debris separator tube 102 open through its length between opposing upstream and downstream open tube ends 104, 105. Tubular vacuum wand 7 is provided with cleaning head 5 attached thereto for fluid cleaning a floor surface. Here, an axial intake connector 106 is sealed to upstream tube end 104 and coupled in fluid communication with exhaust port 20 of tubular vacuum wand 7 for initial dry vacuum cleaning the floor surface. An axial exhaust connector 108 is sealed to opposite downstream tube end 105 of cyclonic debris separator tube 102 and coupled in fluid communication with flexible tubular vacuum return hose 19 which is coupled to source of vacuum 8.

Figure 3:
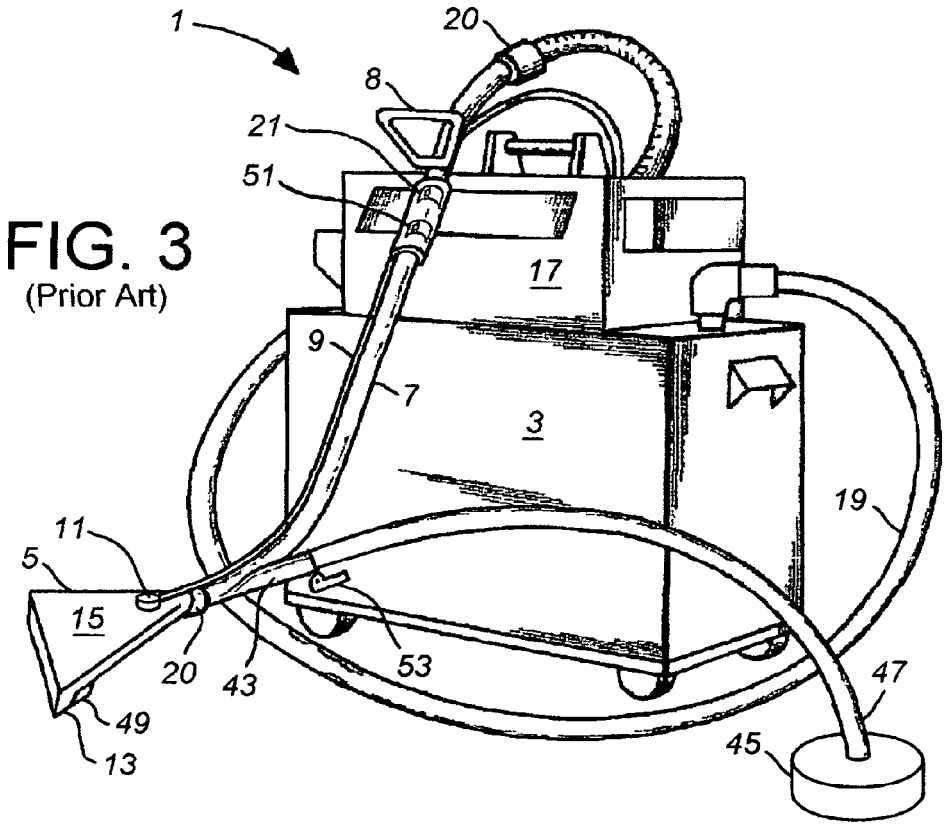
FIG. 3 (Prior Art)
FIG. 3 illustrates another fluid cleaning appliance as illustrated in U.S. patent application Ser. No. 12/378,663 filed in the name of the inventor of the present invention.

As illustrated in FIG. 3, in addition to handle 8 of vacuum wand 7 in-line bagless dry vacuum cleaning appliance 101 optionally includes a handle 109 for aid in controlling cleaning head 5.

Figure 5:
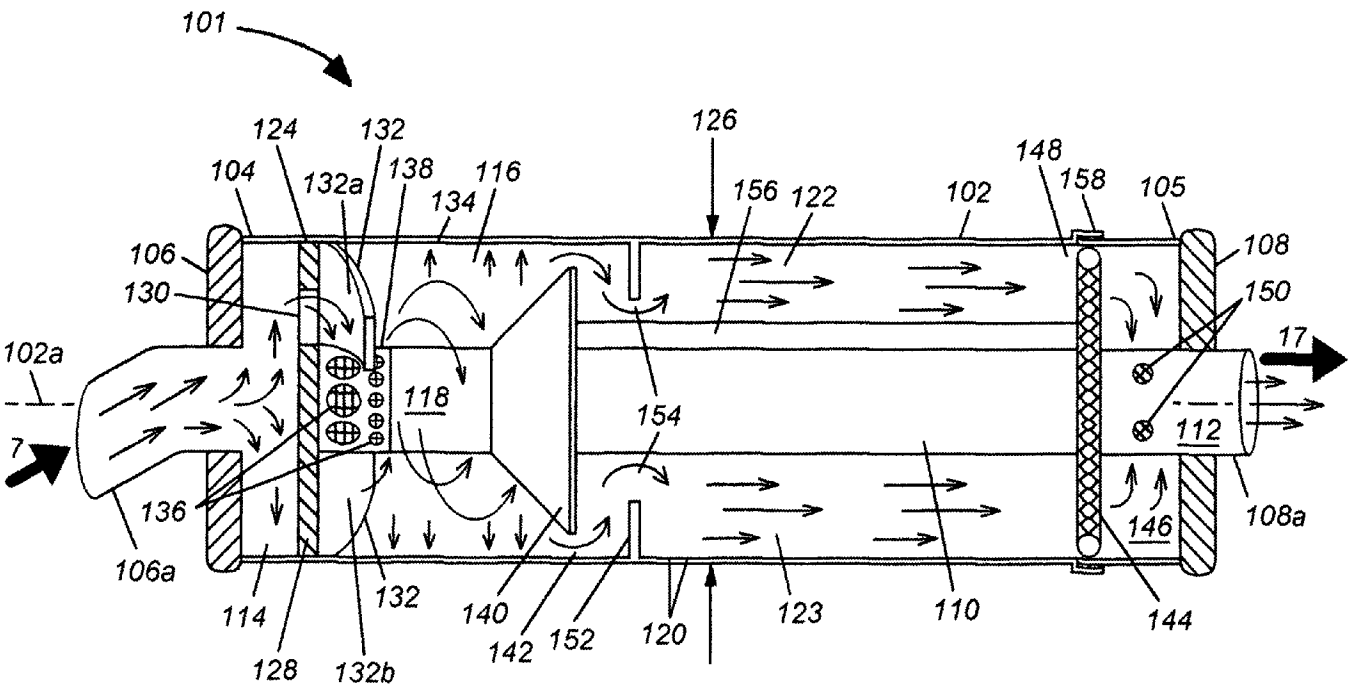
FIG. 5 is a detailed view of the novel in-line bagless dry vacuum cleaning appliance.

FIG. 5 is a detailed view of in-line bagless dry vacuum cleaning appliance 101. Axial intake connector 106 includes an axial intake tube 106*a* positioned substantially along a longitudinal axis 102*a* of separator tube 102 and its upstream tube end 104. Axial intake tube 106*a* receives tubular vacuum wand 7 which is clamped thereto. Axial exhaust connector 108 includes an axial exhaust tube 108*a* positioned substantially along longitudinal axis 102*a* of separator tube 102 and its downstream tube end 105. Axial exhaust tube 108*a* receives flexible tubular vacuum return hose 19 which is coupled to source of vacuum 8. Axial intake tube 106*a* and axial exhaust tube 108*a* are each positioned substantially centrally of respective intake connector 106 and exhaust connector 108 substantially along longitudinal axis 102*a* of separator tube 102 such that an airstream (arrows) is received axially of separator tube 102 and exhausted axially of separator tube 102. The significance of this axial airstream feature is disclosed below.

Separator tube 102 of bagless dry vacuum cleaning appliance 101 includes a continuous tubular central vacuum conduit 110 extended through the center thereof substantially along longitudinal axis 102*a* from axial exhaust connector 108 at downstream tube end 105 toward opposite upstream tube end 104. An open end 112 of central vacuum conduit 110 is sealed through exhaust connector 108 and axial exhaust tube 108*a* which extends externally of separator tube 102 where it couples central vacuum conduit 110 in fluid communication with vacuum return hose 19. Central vacuum conduit 110 extends through cyclonic debris separator tube 102 to an incoming vacuum chamber 114 formed inside separator tube 102 at its opposite upstream tube end 104 adjacent to intake connector 106.

A cyclone chamber 116 is formed within separator tube 102 is formed downstream of incoming vacuum chamber 114, wherein a cyclonic flow region 118 is formed for disentraining particulate material 120 (FIG. 5) from the intake airstream (arrows). Cyclonic flow region 118 communicates with a particle receiving chamber 122 wherein a dead air space 123 is formed for retaining disentrained particulate material 120. Cyclone chamber 116 is formed adjacent to incoming vacuum chamber 114, and an axial spiral "screw" cyclone inlet 124 separates cyclone chamber 116 from adjacent incoming vacuum chamber 114.

Cyclone inlet 124 is shown in cross-section. Cyclone inlet 124 is extended across the diameter 126 of debris separator tube 102. Cyclone inlet 124 is a dam formed of a barrier 128 having at least one and preferably more air inlets 130 formed therethrough, each air inlet 130 is in fluid communication with a spiral "screw" wall 132 inclined between incoming vacuum chamber 114 and cyclone chamber 116, preferably in a position tangential to an interior wall 134 of separator tube 102, for forming a cyclone within cyclonic flow region 118 of cyclone chamber 116.

Here, providing axial intake tube 106*a* of axial intake connector 106 along longitudinal axis 102*a* substantially at the center of upstream tube end 104 permits intake airstream (arrows) to enter centrally of incoming vacuum chamber 114 so that intake air can be evenly distributed across barrier 128 for entering each of air inlets 130 of cyclone inlet 124 with substantially equal force and volume, whereby cyclonic action in cyclonic flow region 118 is substantially balanced. In contrast, the various bagless vacuum cleaning systems of the prior art teach connecting the air flow input tangentially with the side of the cyclone chamber for promoting cyclonic air flow. Even U.S. Pat. No. 7,588,616, which is incorporated herein by reference, teaches a tangential air intake tube into the cyclone chamber.

Inside separator tube 102 central vacuum conduit 110 abuts axial cyclone inlet 124 adjacent to upstream tube end 104, and axial cyclone inlet 124 supports central vacuum conduit 110. Thus, tubular central vacuum conduit 110 extends from incoming vacuum chamber 114, through cyclone and particle receiving chambers 116, 122, to exhaust connector 108 at the opposite downstream end 105 of separator tube 102. A number of vacuum suction holes 136 are formed in outer tubular wall 138 of central vacuum conduit 110 adjacent to axial spiral cyclone inlet 124. Vacuum suction holes 136 are in fluid communication through central vacuum conduit 110 with vacuum return hose 19 and vacuum source 8 for forming a vacuum within cyclone chamber 116 of separator tube 102. As further illustrated, vacuum suction holes 136 are optionally filtered against stray particulate material 120 entering into high pressure blower-type vacuum source 25 through central vacuum conduit 110.

A frusto-conical particle separator 140 is formed on wall 138 of central vacuum conduit 110 for dividing particle receiving chamber 122 from cyclone chamber 116 and cyclonic flow region 118. Particle separator 140 extends radially outwardly from wall 138 of central vacuum conduit 110 without reaching interior wall 134 of cyclonic debris separator tube 102. Particle separator 140 thereby blocks a central portion of separator tube 102 while forming a first circumferential transfer gap 142 adjacent to its interior wall 134 through which disentrained particles 120 of dust and debris may enter particle receiving chamber 122 from cyclone chamber 116. Although circumferential transfer gap 142 is optionally substantially continuous between particle separator 140 and interior wall 134 of cyclonic debris separator tube 102, transfer gap 142 is optionally broken at intervals, for example, by a support structure for such as one or more bridges extended between particle separator 140 and interior wall 134 of cyclonic debris separator tube 102 similarly, for example, spokes of a wheel. Accordingly, such design choices and alternative configurations suitable for the transfer gap 142 are considered to be equivalent configurations contemplated by the invention and falling within the scope of the invention.

A filter 144 is positioned within particle receiving chamber 122 opposite from particle separator 140 and forms a small clean air chamber 146 at extreme end 148 of particle receiving chamber 122 opposite from circumferential transfer gap 142 and adjacent to exhaust connector 108 at downstream end 105 of separator tube 102. Additional vacuum suction holes 150 are formed in central vacuum conduit 110 opposite from incoming vacuum chamber 114 and between filter 144 and downstream end 105 of separator tube 102 for urging disentrained particles 120 toward filter 144 to accumulate away from particle separator 140 and cyclone chamber 116. Suction created at additional vacuum suction holes 150 thus positively conveys disentrained particles 120 away from cyclone chamber 116 and cyclonic flow region 118 into particle receiving chamber 122. Furthermore, suction created at additional vacuum suction holes 150 encourages disentrained particles 120 to remain in particle receiving chamber 122 against the pull of gravity when bagless dry vacuum cleaning appliance 101 is tilted raising downstream end 105 of separator tube 102 above upstream tube end 104. In contrast, conventional upright or canister type vacuum cleaners rely primarily on gravity for retaining disentrained particles in the receiving chamber. In further contrast to prior art bagless dry vacuum cleaning appliances, only in-line bagless dry vacuum cleaning appliance 101 is positioned remote from high pressure blower-type vacuum source 25 in-line between vacuum wand 7 with cleaning head 5 and vacuum return hose 19, so additional suction holes 150 are only useful in in-line bagless dry vacuum cleaning appliance 101 as a means for biasing disentrained particles 120 to migrate toward and remain within receiving chamber 122.

Clean air chamber 146 at extreme end 148 of particle receiving chamber 122 itself is unique. The failure of prior art bagless dry vacuum cleaning appliances to provide additional suction holes 150 adjacent to extreme end 148 of particle receiving chamber 122 away from their cyclone chamber and cyclonic flow region negates any need or use for such a clean air chamber. Rather, in contrast to in-line bagless dry vacuum cleaning appliance 101, the various bagless vacuum cleaning systems of the prior art apparently all used their particle receiving chamber for storing disentrained particles until emptied by the user. Most prior art bagless vacuum cleaning used doors hinged in the bottom dead-end of the particle receiving chamber for evacuating the chamber, whereby clean air chamber 146 of in-line bagless dry vacuum cleaning appliance 101, as well as being useless to the application, was difficult or impossible to implement.

A dam 152 extends radially inwardly of separator tube interior wall 134 between particle separator 140 and particle receiving chamber 122 for forming a second substantially circumferential transfer gap 154 at least partially about central vacuum conduit 110. For example, dam 152 is formed as an at least partial ring substantially circumferentially about central vacuum conduit 110. However, dam 152 is clearly subject to design choices and alternative configurations that may be suitable for forming second transfer gap 154, and such design choices and alternative configurations are considered to be equivalent configurations contemplated by the invention and falling within the scope of the invention. Regardless of design, dam 152 cooperates with particle separator 140 for forming a tortuous transfer path through first and second transfer gaps 142, 154 that limits migration of disentrained particles 120 back toward cyclone chamber 116. Additionally, dam 152 is a fill limit indicator for particle receiving chamber 122, after which indicated fill limit is reached, particle receiving chamber 122 is to be emptied.

Optionally, one or more baffles 156 are positioned within the particle receiving chamber. Baffles 156 operate to reduce and preferably stop the cyclonic flow of air in particle receiving chamber 122 beneath particle separator 140. Baffles 156 thus aid in forming of the dead air space 123 in particle receiving chamber 122 for retaining disentrained particulate material 120. For example, at least one baffle 156 is formed as a fin on wall 138 of central vacuum conduit 110 between particle separator 140 and filter 144 and is extended radially therefrom part way toward interior wall 134 of separator tube 102. Thus, baffles 156 cooperate with particle separator 140 for encouraging particles 120 entrained in cyclonic airstream (arrows) to slow and become disentrained adjacent to circumferential transfer gap 142, whereupon such disentrained particles 120 can easily pass through transfer gap 142 into particle receiving chamber 122 under negative pressure created at vacuum suction holes 136. Extension of baffles 156 from particle separator 140 toward filter 144 encourages formation of dead air space 123 within particle receiving chamber 122 beneath cyclonic flow region 118.

Figure 6:
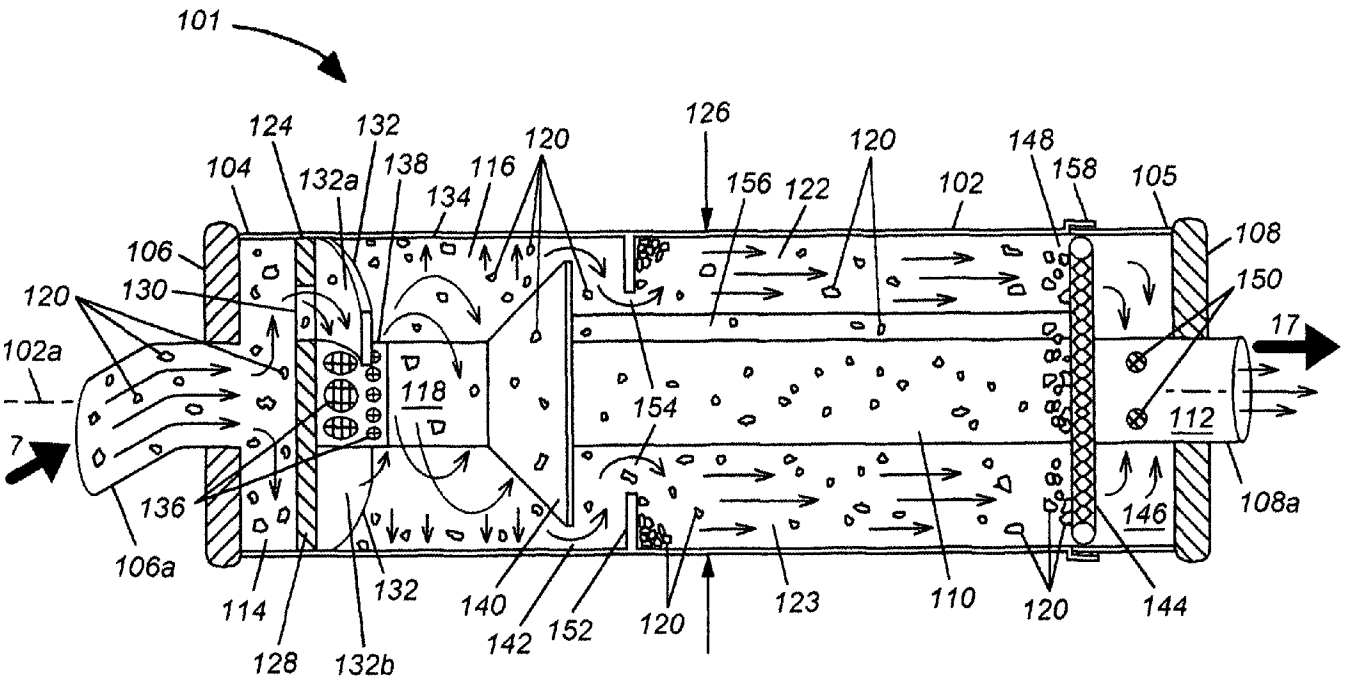
FIG. 6 illustrates operation of the novel in-line bagless dry vacuum cleaning appliance.

FIG. 6 illustrates operation of the novel in-line bagless dry vacuum cleaning appliance. In operation, in-line bagless dry vacuum cleaning appliance 101 eliminates the need for an independent dry vacuum cleaning appliance (not shown) for removing loose dust and debris before fluid cleaning, eliminating both the completely independent dry vacuum cleaning appliance and the independent vacuum source connected to the cleaning head via an auxiliary dry vacuum connection as shown in FIG. 2, for initially dry vacuum cleaning the surface that is the object of fluid cleaning. In-line bagless dry vacuum cleaning appliance 101 is coupled into the cleaning appliance 100 between rigid vacuum wand 7 and flexible vacuum return hose 19. In-line bagless dry vacuum cleaning appliance 101 is thus coupled for capturing and removing particulate material 120 entrained in an airstream (arrows) flowing from cleaning head 5 through vacuum wand 7.

The high pressure blower-type vacuum source 25 is connected to vacuum return hose 19 at axial exhaust tube 108*a* of exhaust connector 108 at downstream end 105 of separator tube 102. When energized, vacuum source 25 thus operates through vacuum holes 136 in tubular wall 138 of central vacuum conduit 110 of in-line bagless dry vacuum cleaning appliance 101 to create a negative pressure or partial vacuum within cyclone chamber 116. Vacuum created in cyclone chamber 116 draws an airstream (arrows) carrying entrained dust and particulate material 120 collected at cleaning head 5 into rigid vacuum wand 7 and through axial intake tube 106*a* of intake connector 106 into incoming vacuum chamber 114 inside separator tube 102 adjacent to upstream tube end 104.

The airstream (arrows) enters cyclone chamber 116 through air inlets 130 of axial screw-type cyclone inlet 124 and travels along spiral inclined walls 132 in a circular pattern around tubular central vacuum conduit 110.

As illustrated, vacuum suction holes 136 include both (larger) apertures adjacent to spiral "screw" walls 132 of cyclone inlet 124 proximate to entry into cyclone chamber 116, and (smaller) apertures spaced toward particle receiving chamber 122 deeper within cyclone chamber 116. Vacuum suction holes 136 (larger) adjacent to spiral "screw" walls 132 of cyclone inlet 124 induce and promote the circular flow pattern by drawing the airstream (arrows) into cyclone chamber 116 along interior concave guide faces 132*a* of curvingly inclined walls 132. The circular flow pattern of the airstream (arrows) travelling around tubular wall 138 of central vacuum conduit 110 encounters exterior convex guide faces 132*b* of curvingly inclined walls 132, which exterior convex guide faces 132*b* guide flow of the airstream (arrows) deeper into cyclone chamber 116 and generally toward frusto-conical particle separator 140. Additionally, vacuum suction holes 136 (smaller) spaced toward particle receiving chamber 122 draw flow of the airstream (arrows) deeper into cyclone chamber 116.

Thus, the circular flow pattern of the airstream (arrows) induced by axial spiral cyclone inlet 124 induces a cyclonic action in the airstream (arrows) positioned tangential to the inside of tubular wall 134 of separator tube 102. Particulate material 120 entrained in the airstream (arrows) enters cyclone chamber 116 carried in a cyclonic airstream (arrows) positioned tangential to interior tube wall 134. The heavier-than-air particulate material 120 is forced by centrifugal acceleration of the cyclonic airstream (arrows) toward tubular interior wall 134, while the lighter air escapes through vacuum holes 136 in tubular wall 138 of central vacuum conduit 110.

As the cyclonic air flow moves cyclonically along interior wall 134 of cyclone chamber 116, the cyclonic airstream (arrows) is disrupted and slowed by contact with frusto-conical particle separator 140. The change in speed and direction of the airstream (arrows) as it flows through cyclone chamber 116 causes particles 120 entrained in airstream to become disentrained. Separated particles 120 have a greater mass and continue to accelerate towards particle separator 140 where they pass through circumferential transfer gap 142 and second circumferential transfer gap 154 around circumferential dam 152 into particle receiving chamber 122. Baffles 156 in particle receiving chamber 122 interrupt and further reduce, and preferably stop, the cyclonic flow of air downstream of particle separator 140. Particulate material 120 disentrained from the cyclonic airstream in cyclone chamber 116 thus collects in particle receiving chamber 122.

Additional suction holes 150 in central vacuum conduit 110 adjacent to downstream separator tube end 105 and intake connector 106 draw a lesser vacuum in clean air chamber 146 at the bottom of particle receiving chamber 122. The lesser vacuum urges the particulate material 120 deeper into particle receiving chamber 122, which avoids reentrainment of disentrained particles 120 into the cyclonic airflow. Filter 144 keeps small clean air chamber 146 clear and avoids drawing particulate material 120 through suction holes 150 into vacuum return hose 19 and vacuum source 25, and ultimately main waste receptacle 3 into which soiled cleaning fluid is routed.

At intervals, or when particulate material 120 filled particle receiving chamber 122 near capacity as indicated by dam 152 as fill limit indicator, exhaust connector 108 is disconnected from separator tube 102 and particle receiving chamber 122 is emptied through exposed open tube end 105. For convenience, filter 144 and small clean air chamber 146 protected thereby are optionally associated with exhaust connector 108 such that disconnection of exhaust connector 108 from separator tube 102 simultaneously separates filter 144 from end 148 of particle receiving chamber 122, and exposes open end 148 of particle receiving chamber 122 for quick and easy emptying of particulate material 120. For example, exhaust connector 108 and associated filter 144 are coupled to separator tube 102 at a connection 158 that is adjacent to filter 144. This arrangement simplifies emptying of particle receiving chamber 122 and provides easy access for cleaning or changing to filter 144. Connection 158 optionally includes a sealing gasket, as well as a convenient mechanical connection. Connection 158 is any convenient connection and alternative connection configurations are considered to be equivalent configurations that are similarly contemplated by the invention and are considered to fall within the scope of the invention.

While the preferred embodiment of the invention has been illustrated and described, it will be appreciated that various changes can be made therein without departing from the spirit and scope of the invention.

What is claimed is:

1. An in-line bagless dry vacuum cleaning appliance, comprising:

a separator tube comprising an intake connector and an exhaust connector;

a vacuum conduit within the separator tube and extended from the exhaust connector toward the intake connector, the vacuum conduit comprising one or more first vacuum suction apertures and one or more second vacuum suction apertures in fluid communication with the exhaust connector;

a cyclone chamber within the separator tube in fluid communication with the intake connector thereof, the cyclone chamber substantially encompassing the one or more first vacuum suction apertures of the vacuum conduit;

a particle receiving chamber in fluid communication with the cyclone chamber;

an axial cyclone inlet in fluid communication between the cyclone chamber and the intake connector of the separator tube;

a particle separator dividing the particle receiving chamber from the cyclone chamber and forming a first transfer aperture therebetween; and a filter positioned between the particle receiving chamber and the one or more second vacuum suction apertures.

2. The cleaning appliance of claim 1, wherein the axial cyclone inlet further comprises a barrier having at least one air inlet formed therethrough in fluid communication with a spiral wall inclined between the intake connector and the cyclone chamber.

3. The cleaning appliance of claim 2, further comprising an incoming vacuum chamber formed between the barrier and the intake connector of the separator tube, the incoming vacuum chamber being in fluid communication between the cyclone chamber and the intake connector.

4. The cleaning appliance of claim 1, further comprising a second transfer aperture between the central vacuum conduit and the interior wall of the separator tube in a position between the particle separator and the particle receiving chamber and offset from the first transfer aperture.

5. The cleaning appliance of claim 4, wherein the first transfer aperture further comprises a substantially circumferential gap adjacent to the interior wall of the separator tube; and wherein the second transfer aperture further comprises a substantially circumferential gap formed between the interior wall of the separator tube and an at least partial dam extended between the central vacuum conduit and the interior wall of the separator tube in a position between the particle separator and the particle receiving chamber.

6. The cleaning appliance of claim 1, wherein the one or more second vacuum suction apertures are further positioned within a clean air chamber that is in fluid communication with the particle receiving chamber; and wherein the filter is further positioned between the particle receiving chamber and the clean air chamber.

7. The cleaning appliance of claim 1, wherein the particle separator further comprises a frusto-conical particle separator coupled to the central vacuum conduit, the frusto-conical particle separator extending radially outwardly from the central vacuum conduit toward interior wall of the separator tube and forming the first transfer gap therebetween.

8. The cleaning appliance of claim 1, further comprising:

a cleaning head comprising a cleaning solution inlet orifice arranged in fluid communication with one or more cleaning solution spray jets thereof, and one or more vacuum cleaning slots; and a cleaning solution delivery tube arranged in fluid communication with the cleaning solution inlet orifice of the cleaning head for delivering there through a flow of pressurized liquid cleaning solution to the one or more cleaning solution spray jets;

a substantially rigid vacuum wand having an intake thereof attached to the cleaning head in fluid communication with the one or more vacuum cleaning slots, and an exhaust remote from the intake and in fluid communication therewith, the remote exhaust port being coupled in fluid communication with the intake connector of the separator tube; and a vacuum return in fluid communication between the exhaust connector of the of the separator tube and a vacuum source.

9. An in-line bagless dry vacuum cleaning appliance, comprising:

a separator tube comprising opposing upstream and downstream tube ends each opening into an interior portion of the separator tube;

an axial intake connector sealed to the upstream tube end of the separator tube and comprising an axial intake tube for receiving an intake airstream;

an axial exhaust connector sealed to the downstream tube end of the separator tube and comprising an axial exhaust tube;

an incoming vacuum chamber formed within the separator tube adjacent to the upstream tube end thereof;

a continuous central vacuum conduit coupled in fluid communication with the axial exhaust tube of the axial exhaust connector at the downstream tube end of the separator tube, the central vacuum conduit being extended substantially longitudinally through the separator tube from the axial exhaust connector toward the opposite upstream tube end, the central vacuum conduit comprising one or more first vacuum suction apertures adjacent to incoming vacuum chamber and in fluid communication with the axial exhaust connector;

a cyclone chamber is formed downstream of the incoming vacuum chamber for forming a cyclonic flow region between the central vacuum conduit and an interior wall of the separator tube adjacent to the incoming vacuum chamber;

a particle receiving chamber in fluid communication with the cyclonic flow region wherein a dead air space is formed for retaining particulate material disentrained from the intake airstream;

an axial spiral cyclone inlet separating the cyclone chamber from the adjacent incoming vacuum chamber, the axial spiral cyclone inlet communicating between the cyclone chamber and the adjacent incoming vacuum chamber;

a particle separator for disentraining particulate material from the intake airstream, the particle separator dividing the particle receiving chamber from the cyclone chamber and the cyclonic flow region and forming a first transfer gap adjacent to the interior wall through which disentrained particulate material may enter the particle receiving chamber from the cyclone chamber communicating therewith;

one or more second vacuum suction apertures in fluid communication between the axial exhaust connector and a portion of the particle receiving chamber distal from the cyclone chamber; and a filter positioned between the particle receiving chamber and the one or more second vacuum suction apertures.

10. The cleaning appliance of claim 9, wherein the axial spiral cyclone inlet further comprises a barrier positioned between the incoming vacuum chamber and the cyclone chamber, the barrier comprising a plurality of air inlets formed therethrough, each air inlet being in fluid communication with a spiral wall in a position tangential to the interior wall of the separator tube and inclined between the incoming vacuum chamber and the cyclone chamber.

11. The cleaning appliance of claim 10, wherein the particle separator further comprises a frusto-conical particle separator inclined from the central vacuum conduit toward the particle receiving chamber.

12. The cleaning appliance of claim 9, further comprising a second transfer gap between central vacuum conduit and the interior wall of the separator tube in a position offset from the first transfer gap along the central vacuum conduit.

13. The cleaning appliance of claim 12, further comprising a substantially circumferential dam extended radially inwardly of the interior wall of the separator tube and offset from the particle separator along the central vacuum conduit and forming the second transfer gap about central vacuum conduit.

14. The cleaning appliance of claim 13, further comprising at least one baffle extended between the central vacuum conduit and the interior wall of the separator tube within the particle receiving chamber.

15. The cleaning appliance of claim 9, further comprising a clean air chamber positioned within the separator tube opposite from the particle separator with the particle receiving chamber positioned therebetween; and wherein the filter is further positioned within the clean air chamber.

16. The cleaning appliance of claim 9, further comprising:

a cleaning head comprising a cleaning solution inlet orifice arranged in fluid communication with one or more cleaning solution spray jets thereof, and one or more dry vacuum cleaning slots thereof; and a cleaning solution delivery tube arranged in fluid communication between the cleaning solution inlet orifice and a supply of pressurized hot liquid cleaning solution for delivering there through a flow of pressurized liquid cleaning solution to the one or more cleaning solution spray jets;

a substantially rigid vacuum wand having an intake end thereof attached to the cleaning head in fluid communication with the one or more vacuum cleaning slots, and an exhaust end remote from the intake end and in fluid communication therewith, the remote exhaust end being coupled in fluid communication with the intake connector of the separator tube; and a flexible vacuum return hose coupled in fluid communication between the exhaust connector of the of the separator tube and a vacuum source.

17. An in-line bagless dry vacuum cleaning appliance, comprising:

means for receiving an intake airstream at least partially laden with heavier-than-air particulate material into a separator tube through an intake connector thereof;

means for applying through an exhaust connector of the separator tube a negative air pressure to spaced-apart first and second vacuum suction apertures in a vacuum conduit positioned within the separator tube and extended from the exhaust connector toward the intake connector, the spaced-apart first and second vacuum suction apertures being in fluid communication with the exhaust connector through the central vacuum conduit;

within the separator tube, means for receiving the intake airstream into an axial cyclone generating inlet in fluid communication with the intake connector of the separator tube;

within the separator tube, means for receiving the intake airstream into a cyclone chamber that is in fluid communication with the axial cyclone generating inlet and that substantially encompasses the one or more first vacuum suction apertures of the vacuum conduit and is in fluid communication therewith, means for forming with the axial cyclone generating inlet the intake airstream into a cyclonic airstream at least partially laden with the heavier-than-air particulate material within a cyclonic flow region in the cyclone chamber between the central vacuum conduit and an interior wall of the separator tube;

means for urging migration of the heavier-than-air particulate material toward the interior wall of the separator tube by centrifugal acceleration of the cyclonic airstream that is at least partially laden with the heavier-than-air particulate material;

means for receiving from the cyclone chamber a first portion of the airstream separated from the heavier-than-air particulate material through the first vacuum holes of the central vacuum conduit;

means for receiving from the cyclone chamber a second portion of the airstream that is at least partially laden with the heavier-than-air particulate material into a first transfer gap adjacent to the interior wall of the separator tube and in fluid communication between the cyclonic flow region of the cyclone chamber and a particle receiving chamber;

means for receiving from the first transfer gap the second portion of the airstream that is at least partially laden with the heavier-than-air particulate material into the particle receiving chamber;

means for separating the heavier-than-air particulate material and the second portion of the airstream;

means for capturing the heavier-than-air particulate material in the particle receiving chamber; and means for receiving the second portion of the airstream through the second vacuum holes of the central vacuum conduit.

18. The cleaning appliance of claim 17, further comprising means for initially filtering the remaining portion of the airstream before receiving the remaining portion of the airstream through the second vacuum holes of the central vacuum conduit.

19. The cleaning appliance of claim 17, further comprising within the cyclone chamber, means for separating the heavier-than-air particulate material from the heavier-than-air particulate material by disrupting and slowing the cyclonic airstream at least partially laden with the heavier-than-air particulate material by contact with a frusto-conical particle separator between the cyclone chamber and the particle receiving chamber.

20. The cleaning appliance of claim 17, further comprising:

means for coupling a cleaning head in fluid communication with a source of pressurized liquid cleaning solution;

means for coupling an intake of a substantially rigid vacuum wand to the cleaning head in fluid communication with one or more vacuum cleaning slots thereof, and coupling an exhaust of the vacuum wand remote from the intake and in fluid communication therewith in fluid communication with the intake connector of the separator tube; and means for coupling a vacuum return in fluid communication between the exhaust connector of the of the separator tube and a vacuum source.

* * * * *